US010520883B2

(12) United States Patent
Horikawa et al.

(10) Patent No.: US 10,520,883 B2
(45) Date of Patent: Dec. 31, 2019

(54) METHOD FOR MANUFACTURING IMAGE BEARING UNIT AND METHOD FOR MANUFACTURING CARTRIDGE

(71) Applicant: CANON KABUSHIKI KAISHA, Tokyo (JP)

(72) Inventors: Tadashi Horikawa, Numazu (JP); Ryuta Murakami, Suntou-gun (JP); Tetsuya Numata, Suntou-gun (JP); Daisuke Makiguchi, Izunokuni (JP); Naoki Matsumaru, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/365,846

(22) Filed: Mar. 27, 2019

(65) Prior Publication Data

US 2019/0302683 A1 Oct. 3, 2019

(30) Foreign Application Priority Data

Mar. 30, 2018 (JP) ..... 2018-068209

(51) Int. Cl.
*G03G 15/00* (2006.01)
*G03G 21/18* (2006.01)
*G03G 15/08* (2006.01)

(52) U.S. Cl.
CPC ..... *G03G 21/181* (2013.01); *G03G 15/0806* (2013.01); *G03G 21/1814* (2013.01);
(Continued)

(58) Field of Classification Search
CPC ..... G03G 21/181; G03G 21/1814; G03G 21/1821; G03G 15/0806; G03G 2215/00987
See application file for complete search history.

(56) References Cited

U.S. PATENT DOCUMENTS 6,643,482 B2 11/2003 Higeta et al.
6,941,092 B2 9/2005 Yokoi
(Continued)

FOREIGN PATENT DOCUMENTS

JP 2002014592 A 1/2002
JP 2004157281 A 6/2004
(Continued)

OTHER PUBLICATIONS

Copending U.S. Appl. No. 16/367,722, filed Mar. 28, 2019 (a copy is not included because the cited application is not yet available to the public and the Examiner has ready access to the cited application).

(Continued)

*Primary Examiner* — Hoang X Ngo
(74) *Attorney, Agent, or Firm* — Rossi, Kimms & McDowell LLP

(57) ABSTRACT

A manufacturing method includes a removing step for removing at least a part of a contact portion of a cover portion from a supporting member, the cover portion being configured to come into contact with a projecting portion included in a frame when the supporting member is deformed to allow a second engaged portion to be detached from an engaging portion in a state in which a fixed portion of the supporting member is fixed to the frame, a deforming step for deforming the supporting member to allow the second engaged portion to be detached from the engaging portion in the state in which the fixed portion is fixed to the frame, and a separating step for detaching an engaging portion from a first engaged portion and separating a developing unit from the frame.

16 Claims, 10 Drawing Sheets

(52) U.S. Cl.
CPC ..... *G03G 21/1821* (2013.01); *G03G 2215/00987* (2013.01)

(56) References Cited

U.S. PATENT DOCUMENTS

| | | | | |
|---|---|---|---|---|
| 8,238,784 | B2 | 8/2012 | Kusudo et al. | |
| 8,311,449 | B2 | 11/2012 | Kusudo et al. | |
| 2004/0091282 | A1* | 5/2004 | Yokoi | G03G 21/181 399/109 |
| 2005/0117935 | A1 | 6/2005 | Hoshi | |
| 2007/0025760 | A1 | 2/2007 | Williams | |
| 2009/0110434 | A1* | 4/2009 | Kusudo | G03G 15/0813 399/109 |

FOREIGN PATENT DOCUMENTS

| | | | |
|---|---|---|---|
| JP | 2005077751 | A | 3/2005 |
| JP | 2008033271 | A | 2/2008 |
| JP | 2009109848 | A | 5/2009 |
| WO | 2010004854 | A1 | 1/2010 |

OTHER PUBLICATIONS

Extended European Search Report issued in European Appln. No. 19166055.4 dated Oct. 28, 2019.

* cited by examiner

METHOD FOR MANUFACTURING IMAGE BEARING UNIT AND METHOD FOR MANUFACTURING CARTRIDGE

BACKGROUND OF THE INVENTION

Field of the Invention

The present invention relates a manufacturing method (a recycling method) for manufacturing an image bearing unit that supports an image bearing member used in an electrophotographic image forming apparatus and a manufacturing method (a recycling method) for a manufacturing cartridge used in the electrophotographic image forming apparatus.

Description of the Related Art

In an electrophotographic image forming apparatus (hereinafter simply referred to as "image forming apparatus" as well) such as an electrophotographic copying machine or an electrophotographic printer, a process cartridge system is widely used as an apparatus configuration with which toner supply and maintenance of various process means are easy. As the configuration of a process cartridge, there is a process cartridge configured from a photosensitive drum unit (hereinafter, drum unit) including a photosensitive drum, which is an image bearing member, and a developing unit including developing means such as a developing roller. In order to dispose the photosensitive drum and the developing roller in a predetermined opposed state, there is a configuration in which the drum unit and the developing unit are coupled to be capable of swinging with respect to each other and urging means for urging the developing means in a direction in which the developing means comes into contact with the photosensitive drum is provided. In that case, a configuration is sometimes used in which the drum unit and the developing unit are combined by a supporting member (a side cover) joined to one end in a rotation axis direction of the photosensitive drum. The process cartridge consumes toner stored therein according to repetition of an image forming operation. When the toner is further consumed and an image of quality requested by a user cannot be formed, the process cartridge loses a value thereof. Concerning the used process cartridge that has lost the value, a recycling method that can recycle the used process cartridge has been proposed. In such a recycling method for the process cartridge, disassembling and cleaning of the process cartridge, refilling of the toner, and the like are performed. In the disassembly of the process cartridge, separation of the drum unit and the developing unit is performed. In the separation of the drum unit and the developing unit, a method of deforming the supporting member (the side cover) and separating the drum unit and the developing unit in a state in which a part of the supporting member (the side cover) is joined to the developing unit has been proposed (Japanese Patent Application Laid-open No. 2004-157281).

The present invention further develops the related art explained above.

SUMMARY OF THE INVENTION

An object of the present invention is to provide a simple manufacturing method for disassembling a material unit and manufacturing an image bearing unit that supports an image bearing member. In other words, the object of the present invention is to provide a simple disassembling method for the material unit.

In order to achieve the object, a manufacturing method for manufacturing an image bearing unit of the present invention is a manufacturing method for manufacturing an image bearing unit from a material unit, the material unit including:

an image bearing member;

a frame including a first engaged portion, the frame including a projecting portion projecting toward an outer side of the frame with respect to an axis direction of the image bearing member;

a supporting member including a fixed portion fixed to the frame, the supporting member including a bearing portion that supports the image bearing member, a through-hole, a second engaged portion opposed to the first engaged portion, and a cover portion that covers at least a part of the projecting portion penetrating the through-hole, the cover portion including a contact portion; and a developing unit including an engaging portion, the engaging portion engaging with the first engaged portion and the second engaged portion such that the developing unit being swingably coupled to the frame, wherein the contact portion is configured to come into contact with the projecting portion when the supporting member is deformed to allow the second engaged portion to be detached from the engaging portion in a state in which the fixed portion is fixed to the frame, the manufacturing method comprising:

a removing step for removing at least a part of the contact portion from the supporting member;

a deforming step for deforming the supporting member to allow the second engaged portion to be detached from the engaging portion in the state in which the fixed portion is fixed to the frame; and a separating step for detaching the engaging portion from the first engaged portion and separating the developing unit from the frame.

In order to achieve the object, a manufacturing method for manufacturing a cartridge detachably attachable to an apparatus main body of an image forming apparatus of the present invention includes:

a manufacturing step for manufacturing the image bearing unit according to the manufacturing method for manufacturing the image bearing unit of the present invention; and a developing-unit attaching step for attaching the developing unit or a developing unit different from the developing unit to the first engaged portion.

(for US and CN)

In order to achieve the object, a manufacturing method for manufacturing a cartridge detachably attachable to an apparatus main body of an image forming apparatus of the present invention includes:

a manufacturing step for manufacturing the image bearing unit according to the manufacturing method for manufacturing the image bearing unit of the present invention; and a developing-unit attaching step for attaching the developing unit or a developing unit different from the developing unit to the first engaged portion.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

A manufacturing method for manufacturing an image bearing unit according to an embodiment of the present invention is explained with reference to FIGS. 1 to 10. The image bearing unit is used for manufacturing (reproduction) of a cartridge used in an electrophotographic image forming apparatus. The electrophotographic image forming apparatus forms an image on a recording material (a recording medium) such as a recording paper or a plastic sheet using an electrophotographic image forming system. Examples of the electrophotographic image forming apparatus include an electrophotographic copying machine, an electrophotographic printer (an LED printer, a laser beam printer, etc.), a facsimile apparatus, and a word processor. The process cartridge is obtained by integrating, as a cartridge, a photosensitive body functioning as an image bearing member and process means that acts on the photosensitive body. The process cartridge is detachably attached to an apparatus main body of the electrophotographic image forming apparatus. Configuration examples of the process cartridge include a configuration in which the photosensitive body and at least one of developing means, charging means, and cleaning means functioning as the process means are integrated as a cartridge.

In the following explanation, a longitudinal direction coincides with an axis direction (a rotation axis direction) of an electrophotographic photosensitive drum. In the longitudinal direction, a side where the electrophotographic photosensitive drum receives a driving force from the apparatus main body of the electrophotographic image forming apparatus is represented as a driving side and the opposite side of the driving side is represented as a nondriving side.

Figure 2:
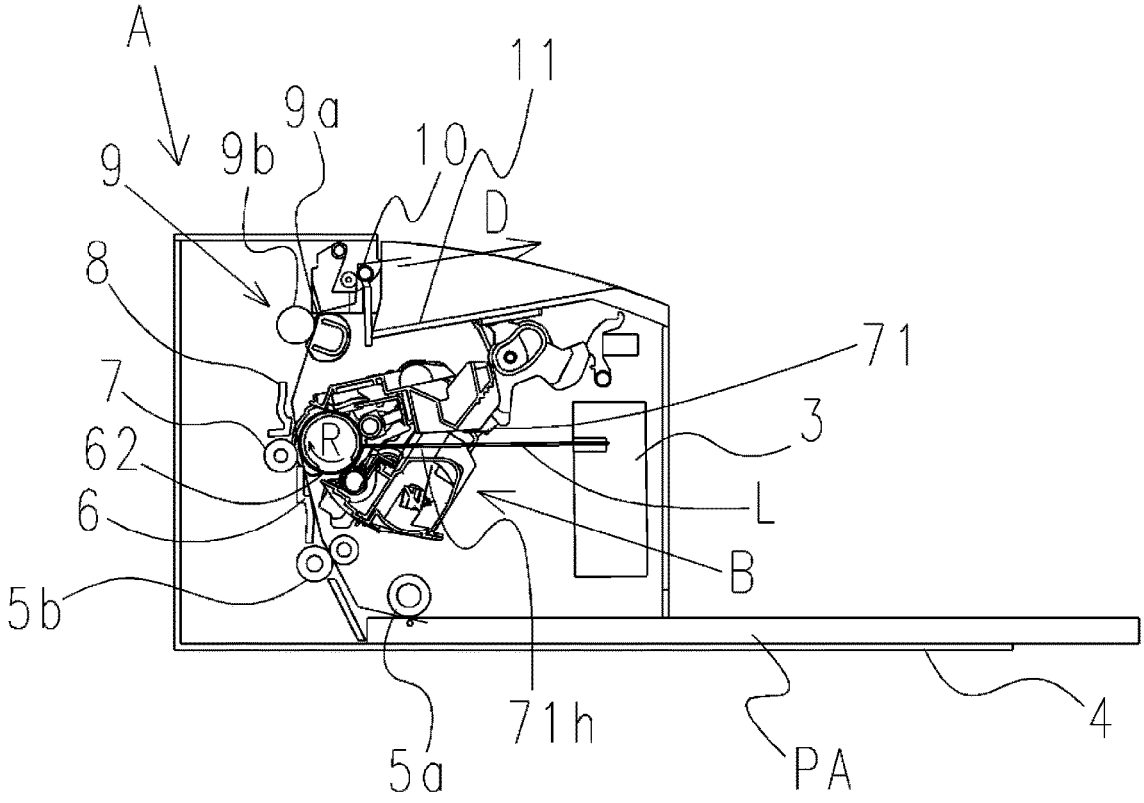
FIG. 2 is a sectional view of an apparatus main body of an image forming apparatus and a process cartridge in the embodiment.
Figure 3:
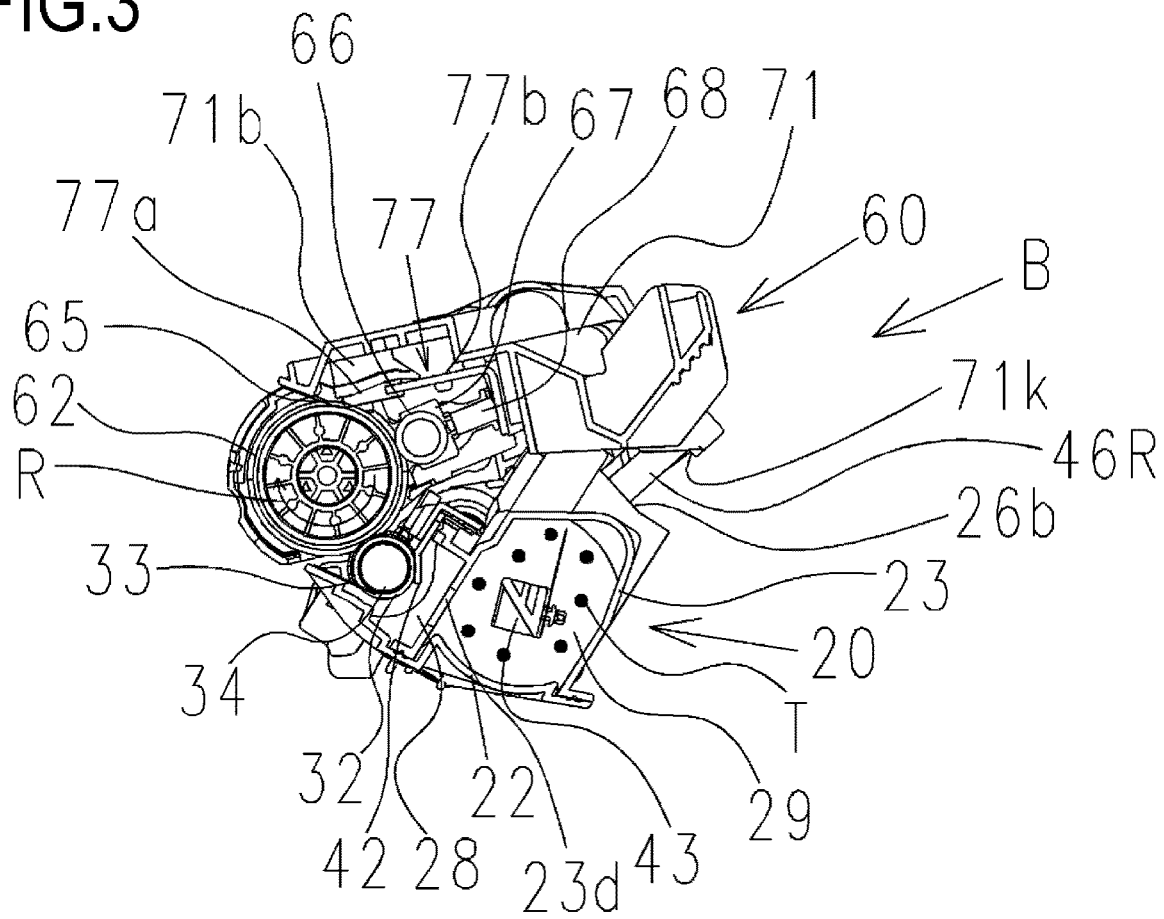
FIG. 3 is a sectional view of the process cartridge in the embodiment.

An overall configuration of the image forming apparatus and an image forming process in this embodiment are explained with reference to FIGS. 2 and 3. FIG. 2 is a sectional view of an apparatus main body (an electrophotographic image forming apparatus main body or an image forming apparatus main body) A and a process cartridge (hereinafter referred to as cartridge B) of an electrophotographic image forming apparatus according to the embodiment of the present invention. FIG. 3 is a sectional view of the cartridge B. The apparatus main body A is a portion excluding the cartridge B among constituent portions of the electrophotographic image forming apparatus.

Overall Configuration of the Electrophotographic Image Forming Apparatus

The electrophotographic image forming apparatus (the image forming apparatus) shown in FIG. 2 is a laser beam printer that makes use of electrophotography in which the cartridge B is detachably attachable to the apparatus main body A. When the cartridge B is attached to the apparatus main body A, the cartridge B is disposed such that a latent image can be formed on an electrophotographic photosensitive drum 62 (hereinafter referred to as photosensitive drum 62) functioning as an image bearing member of the cartridge B by an exposing device 3 (a laser scanner unit). A sheet tray 4 that stores a recording material (hereinafter referred to as sheet material PA), on which an image is formed, is disposed on the lower side of the cartridge B.

Further, in the apparatus main body A, a pickup roller 5*a*, a feeding roller pair 5*b*, a transfer guide 6, a transfer roller 7, a conveyance guide 8, a fixing device 9, a discharge roller pair 10, and the like are sequentially disposed along a conveying direction D of the sheet material PA. The fixing device 9 is configured by a heating roller 9*a* and a pressurizing roller 9*b*.

Image Forming Process

An overview of an image forming process is explained. The photosensitive drum 62 is driven to rotate, based on a print start signal, at predetermined circumferential speed (process speed) in an arrow R direction in FIG. 2. As shown in FIG. 3, a charging roller 66 (a charging member) applied with a bias voltage comes into contact with the outer circumferential surface of the photosensitive drum 62 and uniformly and equally charges the outer circumferential surface of the photosensitive drum 62. As shown in FIG. 2, the exposing device 3 outputs a laser beam L corresponding to image information. The laser beam L passes through a laser opening 71*h* provided in a drum supporting frame 71 of the cartridge B and scans and exposes the outer circumferential surface of the photosensitive drum 62. Consequently, an electrostatic latent image corresponding to the image information is formed on the outer circumferential surface of the photosensitive drum 62.

On the other hand, as shown in FIG. 3, in a developing unit 20 functioning as a developing device, toner T in a toner chamber 29 is agitated and conveyed by rotation of a conveying member (an agitating member) 43 and delivered to a toner supply chamber 28. The toner T is carried on the surface of a developing roller 32 by a magnetic force of a magnet roller 34 (a fixed magnet). The developing roller 32 is a developer carrying body that carries the toner T on the surface thereof in order to develop a latent image formed on the photosensitive drum 62. The toner T is restricted in a layer thickness on the circumferential surface of the developing roller 32 while being triboelectrically charged by a developing blade 42. The toner T is supplied to the photosensitive drum 62 according to an electrostatic latent image and develops the latent image. Consequently, the latent image is visualized as a toner image.

As shown in FIG. 2, the sheet material PA stored in a lower part of the apparatus main body A is delivered from the sheet tray 4 by the pickup roller 5*a* and the feeding roller pair 5*b*. The sheet material PA is conveyed to a transfer position between the photosensitive drum 62 and the transfer roller 7 through the transfer guide 6. In the transfer position, the toner image is transferred onto the sheet material PA from the photosensitive drum 62.

The sheet material PA, onto which the toner image is transferred, is separated from the photosensitive drum 62 and conveyed to the fixing device 9 along the conveyance guide 8. The sheet material PA passes through a nip portion of the heating roller 9*a* and the pressurizing roller 9*b* configuring the fixing device 9. The toner image is subjected to pressurizing/heating and fixing processing in the nip portion and fixed on the sheet material PA. The sheet material PA, which has been subjected to the toner image fixing processing, is conveyed to the discharge roller pair 10 and discharged to the discharge tray 11.

On the other hand, as shown in FIG. 3, residual toner on the outer circumferential surface of the photosensitive drum 62 after the transfer is removed by a cleaning blade 77. The photosensitive drum 62 is used for the image forming process again. The toner T removed from the photosensitive drum 62 is stored in a waste toner chamber 71*b* of a photosensitive drum unit (hereinafter, drum unit) 60 functioning as an image bearing unit. The drum unit 60 is a unit that supports the photosensitive drum 62.

In the above explanation, the charging roller 66, the developing roller 32, the transfer roller 7, and the cleaning member 77 are process means that acts on the photosensitive drum 62.

Overall Configuration of the Cartridge

Figure 4:
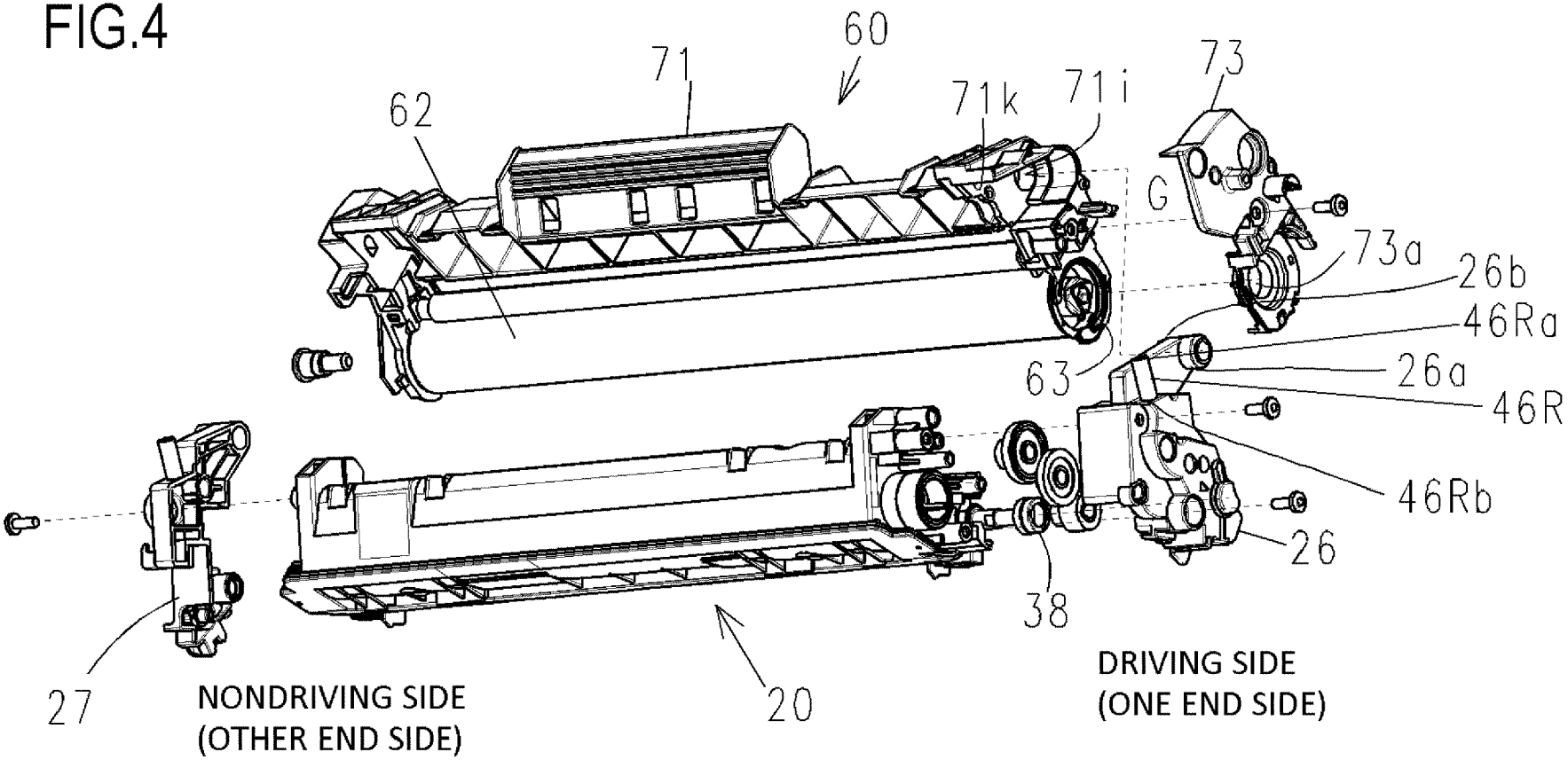
FIG. 4 is an exploded perspective view of the process cartridge in the embodiment.
Figure 5:
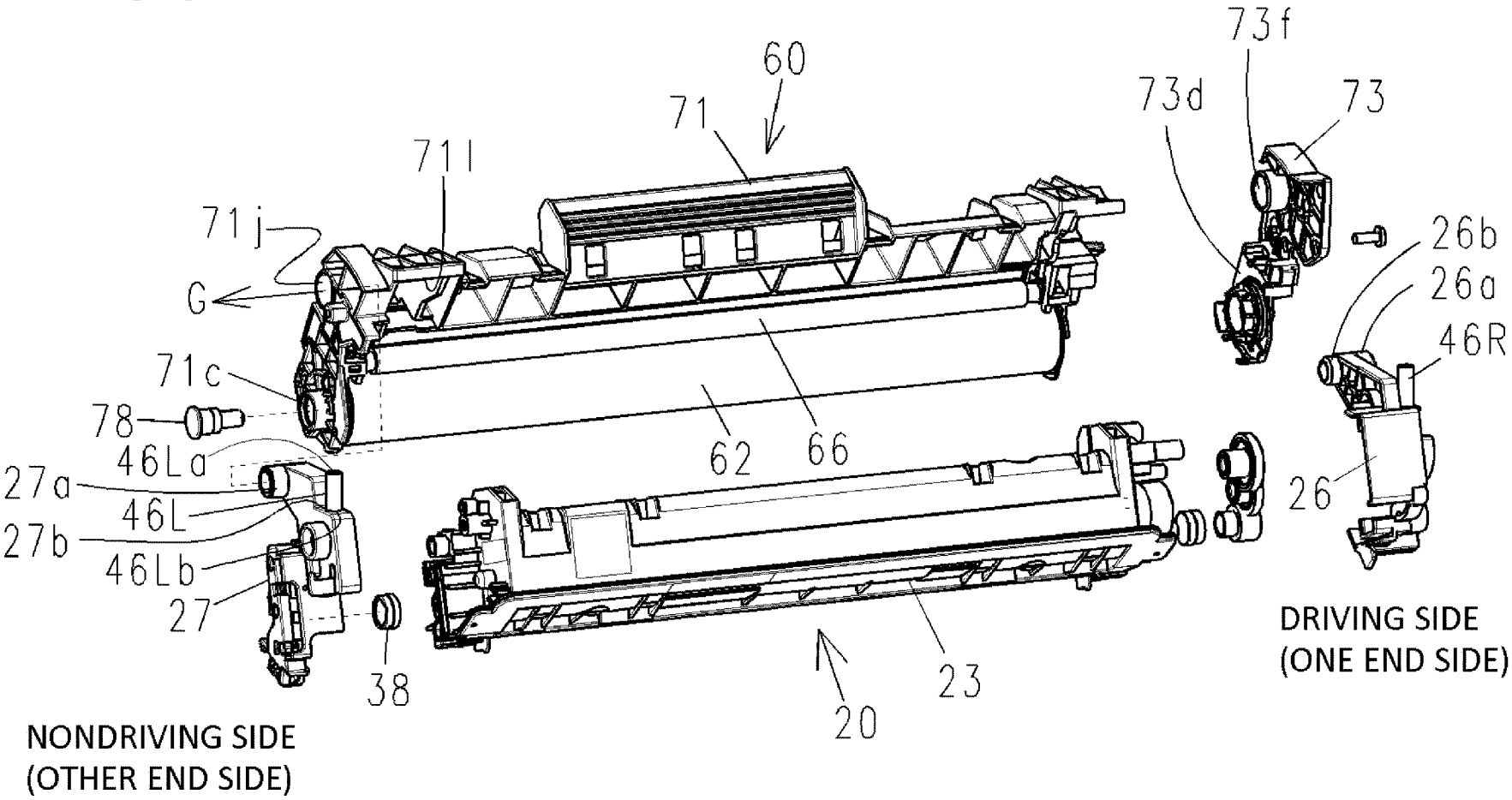
FIG. 5 is an exploded perspective view of the process cartridge in the embodiment.
Figure 6:
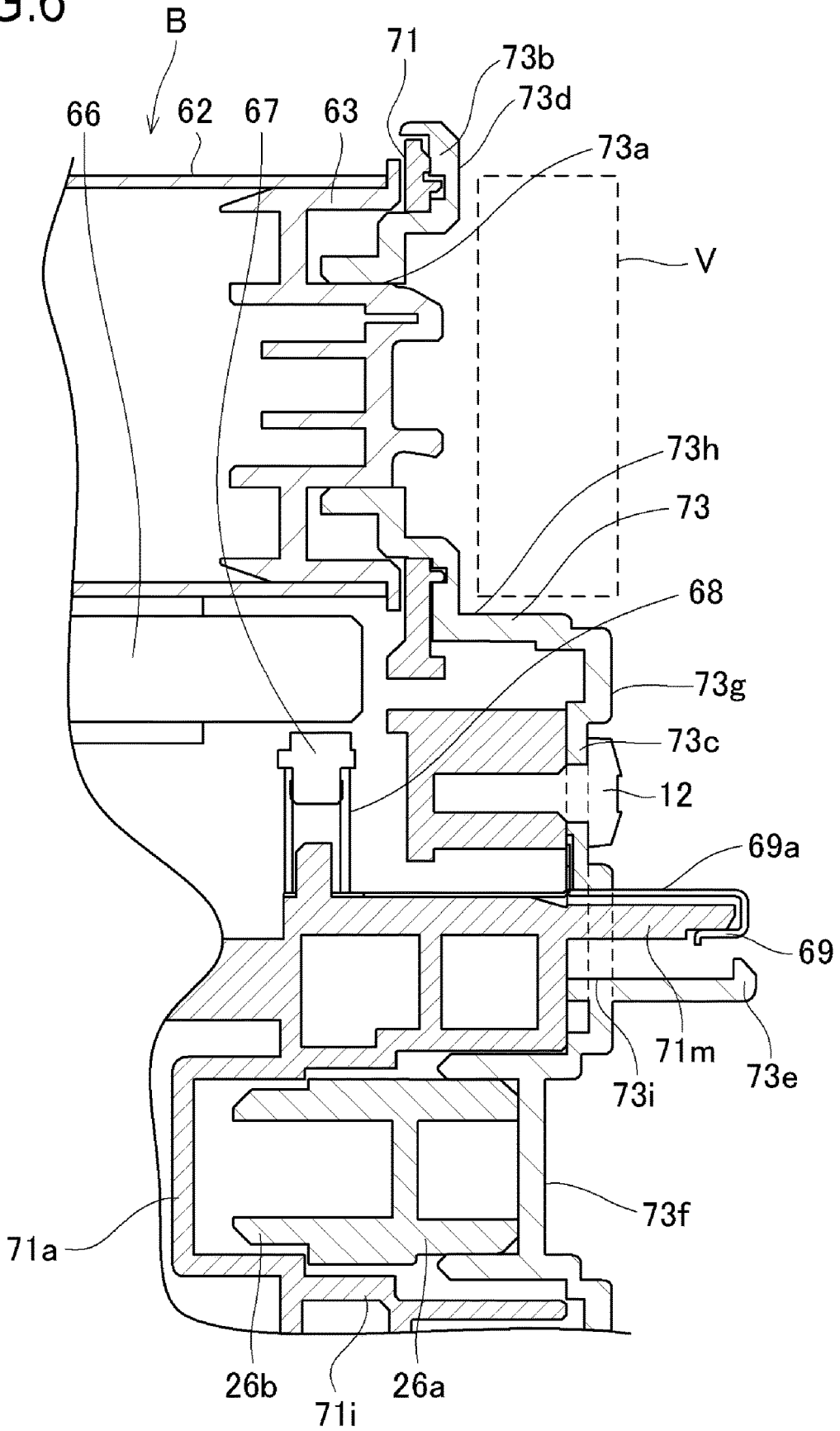
FIG. 6 is an explanatory diagram showing the configuration of the process cartridge in the embodiment.
Figure 7A:
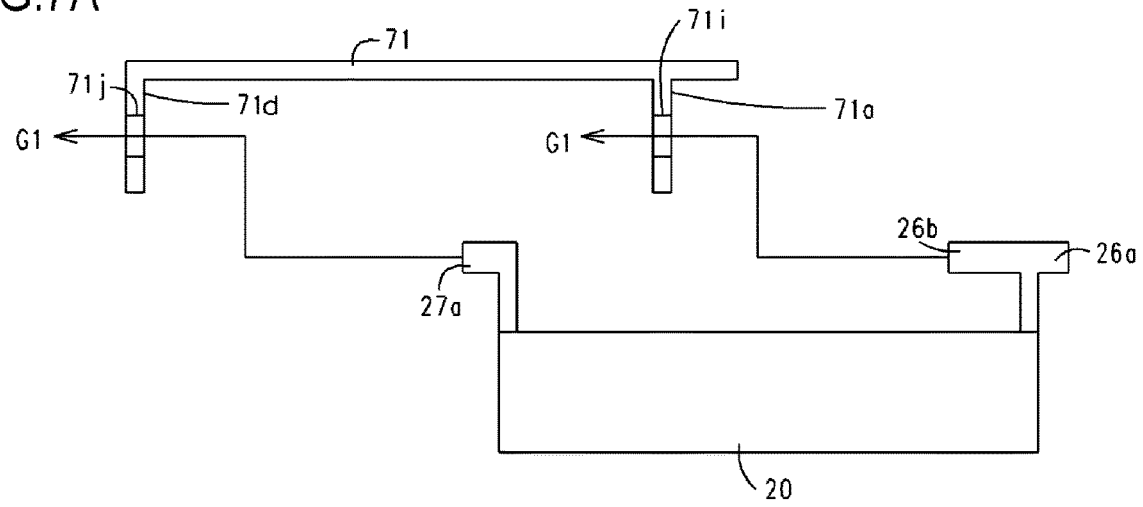
FIGS. 7A to 7C are explanatory diagrams showing a procedure of combination of the drum unit and the developing unit in the embodiment.
Figure 7B:
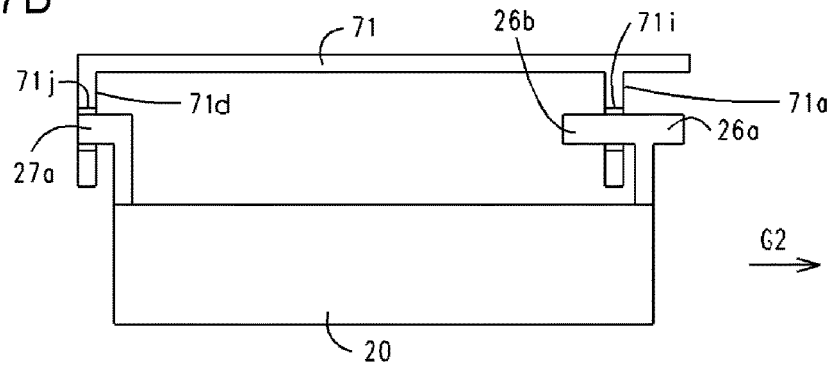
Figure 7C:
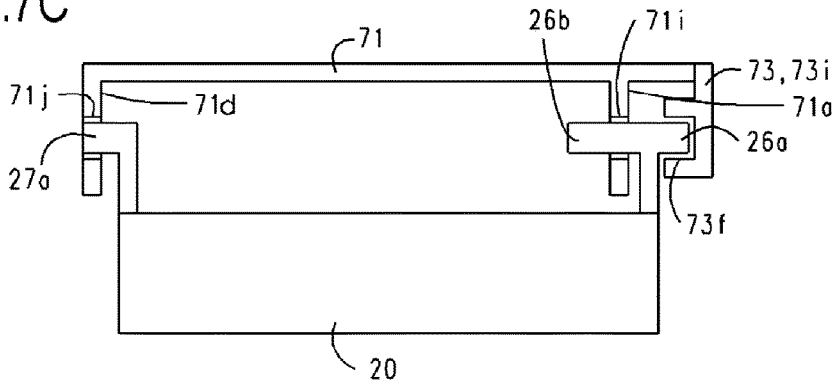
Figure 8:
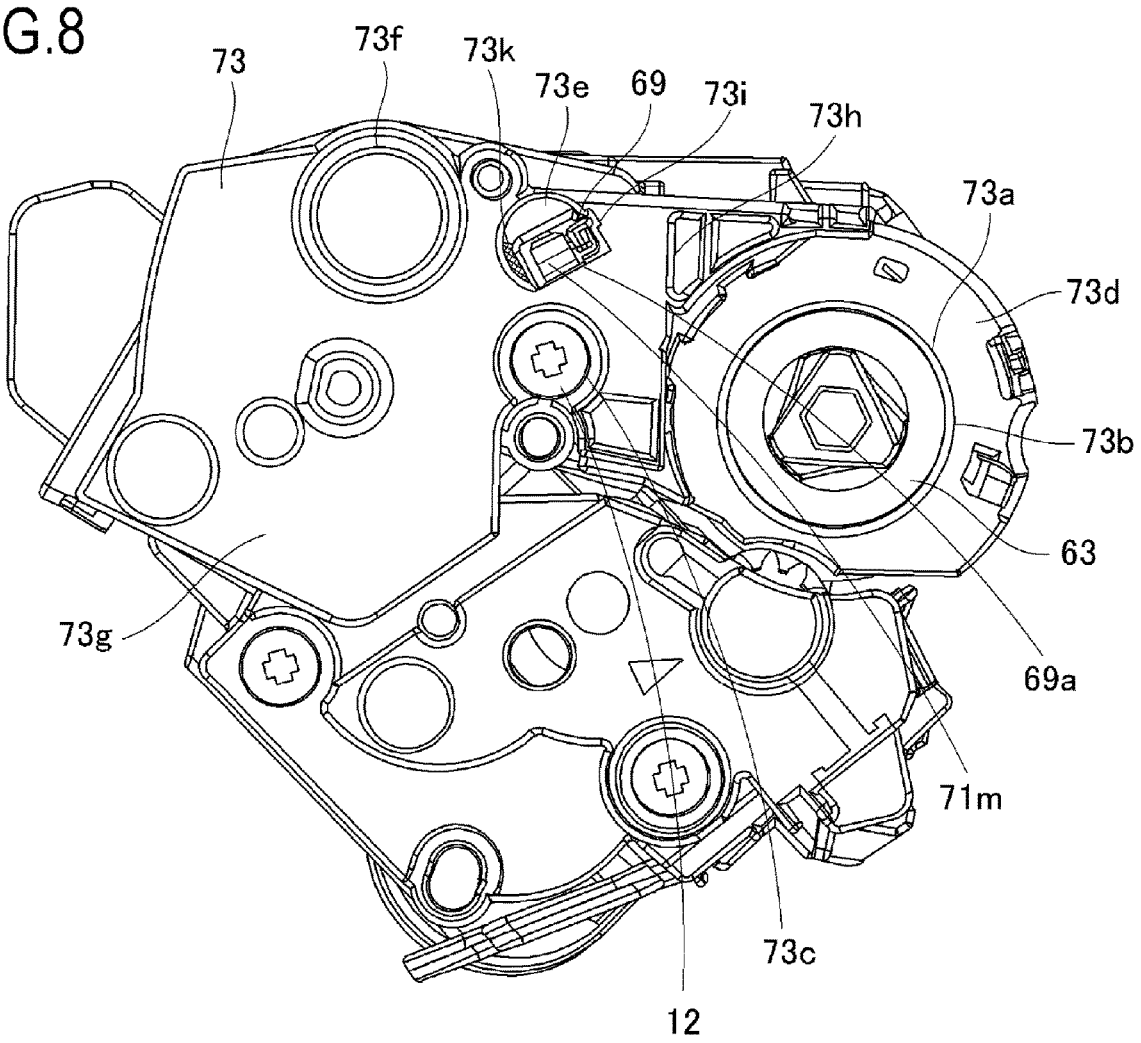
FIG. 8 is a longitudinal side view showing the configuration of the process cartridge in the embodiment.

An overall configuration of the cartridge B is explained with reference to FIGS. 3 to 8. FIG. 3 is a sectional view of the cartridge B. FIGS. 4 and 5 are perspective views for explaining the configuration of the cartridge B. FIG. 6 is an explanatory diagram for explaining the configuration of the cartridge B. FIGS. 7A to 7C are explanatory diagrams showing a procedure of combination of the drum unit 60 and the developing unit 20. FIG. 8 is a longitudinal side view showing the configuration of the cartridge B.

The cartridge B is formed from the drum unit 60 and the developing unit 20.

First, the configuration of the drum unit 60 is explained.

The drum unit 60 includes the photosensitive drum 62, the charging roller 66, and the cleaning member 77. The drum unit 60 includes the drum supporting frame 71 that supports the charging roller 66 and the cleaning member 77. A driving-side drum end portion member 63 provided on a driving side fits with a hole portion 73*a* (a bearing portion) of a drum supporting member 73 functioning as a supporting member, whereby the photosensitive drum 62 is rotatably supported on the driving side. A part of the drum supporting member 73 is fixed to the drum supporting frame 71. In a broad sense, the drum supporting member 73 and the drum supporting frame 71 can be collectively referred to as drum supporting frame as well.

As shown in FIG. 6, the drum supporting member 73 is formed in a shape having a step. In the longitudinal direction, a first surface 73*d* functioning as an image bearing member supporting portion, on which the hole portion 73*a* is provided, is disposed further on the inner side than a second surface 73*g* on which a cover portion 73*e* (explained below) and a development supporting portion 73*f* (explained below) are provided. This is because a driving coupling (not shown in FIG. 6) of the apparatus main body A is disposed in a region V (a broken line portion in FIG. 6). The driving coupling engages with the driving-side drum end portion member 63 and transmits a driving force to the process cartridge B. The first surface 73*d* and the second surface 73*g* are connected by a combining portion 73*h*.

A fixing method for the drum supporting member 73 and the drum supporting frame 71 is as explained below. The drum supporting member 73 includes a first fixed portion 73*b* functioning as an adhesive portion to the drum supporting frame 71 and a second fixed portion 73*c*. The first fixed portion 73*b* is provided on the first surface 73*d*. The second fixed portion 73*c* is provided on the second surface 73*g*.

In this embodiment, the first fixed portion 73*b* is bonded to the drum supporting frame 71 because a combination space in the longitudinal direction is small. When the drum supporting member 73 and the drum supporting frame 71 are formed of a styrene-based resin composition, the first fixed portion 73*b* can be bonded using a terpene-based solvent. This is because the terpene-based solvent has a function of dissolving the styrene-based resin composition. When one of the drum supporting member 73 and the drum supporting frame 71 is not formed of the styrene-based resin composition, the first fixed portion 73*b* can be fixed by another means such as an adhesive or a double sided tape.

The second fixed portion 73*c* has a large combination space in the longitudinal direction compared with the first fixed portion 73*b*. Therefore, the second fixed portion 73*c* can be fixed using a screw 12.

On the nondriving side, as shown in FIG. 5, a hole portion (not shown in FIG. 5) of a nondriving-side drum end portion member is rotatably supported by a drum shaft 78, which is a shaft member, inserted into a hole portion 71*c* provided in the drum supporting frame 71.

As shown in FIG. 3, the cleaning blade 77 is formed by a rubber blade 77*a*, which is a blade-like elastic member formed of rubber functioning as an elastic member, and a supporting member 77*b* that supports the rubber blade 77*a*. The rubber blade 77*a* is in contact with the photosensitive drum 62 in a counter direction with respect to a rotating direction of the photosensitive drum 62. That is, the rubber blade 77*a* is in contact with the photosensitive drum 62 such that the distal end portion of the rubber blade 77*a* faces an upstream side in the rotating direction of the photosensitive drum 62.

As shown in FIG. 3, a sealing sheet 65 for preventing waste toner from leaking from the drum supporting frame 71 is provided at an edge portion of the drum supporting frame 71 to be in contact with the photosensitive drum 62.

The charging roller 66 is rotatably attached to the drum unit 60 via a charging roller bearing 67 at both end portions in the longitudinal direction of the drum supporting frame 71. The charging roller bearing 67 is pressurized toward the photosensitive drum 62 by an urging member 68, whereby the charging roller 66 is in press contact with the photosensitive drum 62. Consequently, the charging roller 66 rotates following the rotation of the photosensitive drum 62.

As shown in FIG. 6, power feed to the charging roller 66 is performed via a charging contact (electrode) 69, the urging member 68, and the charging roller bearing 67 from a contact member (not shown in FIG. 6) of the apparatus main body A. The charging contact 69, the urging member 68, and the charging roller bearing 67 are formed of a material having electric conductivity. On the other hand, the drum supporting frame 71 includes a charging-contact disposing portion 71*m* (a projecting portion) projecting outward (in a direction toward the outer side of the rum supporting frame 71) in the longitudinal direction from a longitudinal end face on one end side of the drum supporting frame 71. In this embodiment, the charging contact 69 is formed of a sheet metal and disposed to cover the charging-contact disposing portion 71*m* (the projecting portion). The charging contact 69 includes a main-body-contact contact portion 69*a* electrically connected to a not-shown main body contact. In the drum supporting member 73, a through-hole 73*i* through which the charging contact 69 and the charging-contact disposing portion 71*m* can pass (penetrate) and a cover portion 73*e* that covers at least a part of the charging-contact disposing portion 71*m* are provided. In the longitudinal direction, the charging contact 69 and the charging-contact disposing portion 71*m* penetrate through the through-hole 73*i* from the inner side to the outer side. As shown in FIGS. 6 and 8, the cover portion 73*e* is located on the outer side of the through-hole 73*i* in the longitudinal direction. The cover portion 73*e* covers at least a part of the charging contact 69 and the charging-contact disposing portion 71*m* that penetrate through the through-hole 73*i*. Specifically, the cover portion 73*e* partially covers the charging-contact disposing portion 71*m* and the charging contact 69, which penetrate through the through-hole 73*i*, to expose the main-body-contact contact portion 69*a* of the charging contact 69. The cover portion 73*e* has two roles. A first role is a role of preventing a user from touching an edge of the charging contact 69 formed of the sheet metal. A second role is a role of protecting the charging contact 69 and the charging-contact disposing portion 71*m* from being damaged when the user hits the cartridge B against the charging contact 69 and the charging-contact disposing portion 71*m* by mistake.

The configuration of the developing unit 20 is explained.

As shown in FIG. 3, the developing unit 20 includes the developing roller 32, a developer container 23, and the developing blade 42. The developing roller 32 is rotatably attached to the developer container 23 by a driving-side development bearing 26 (FIG. 4) and a nondriving-side development bearing 27 (FIG. 5) provided at both ends in the longitudinal direction. The driving-side development bearing 26 and the nondriving-side development bearing 27 are fixed to the developer container 23 by a screw (not shown in FIG. 3).

As shown in FIGS. 4 and 5, in the developing roller 32, interval retaining members 38 are attached to both ends in the longitudinal direction of the developing roller 32. The interval retaining members 38 and the photosensitive drum 62 come into contact, whereby the developing roller 32 is held with a very small gap from the photosensitive drum 62. As shown in FIG. 3, a sealing sheet 33 is provided at an edge portion of a bottom member 22 to be in contact with the developing roller 32. The sealing sheet 33 plays a role for preventing toner from leaking from the developing unit 20.

A combination configuration of the developing unit 20 and the drum unit 60 is explained. As shown in FIGS. 4 and 5, in the drum supporting frame 71, a driving-side frame hole 71*i* functioning as a first engaged portion (a driving-side engaged portion) and a nondriving-side frame hole (a nondriving-side engaged portion or a nondriving-side unit supporting portion) 71*j* are provided. As shown in FIG. 5, the development supporting portion (a driving-side unit supporting portion) 73*f* functioning as a second engaged portion is provided in the drum supporting member 73. In the longitudinal direction, the development supporting portion 73*f* is disposed on the outer side of the driving-side frame hole 71*i* and opposed to the driving-side frame hole 71*i*. In other words, the development supporting portion 73*f* overlaps the driving-side frame hole 71*i* when viewed from the longitudinal direction.

On the other hand, as shown in FIGS. 4 and 5, in the driving-side development bearing 26 of the developing unit 20, a first development supporting boss 26*a* functioning as a first shaft portion and a second development supporting boss 26*b* functioning as a second shaft portion are provided. In the longitudinal direction, directions in which the first development supporting boss 26*a* and the second development supporting boss 26*b* extend are opposite directions. The first development supporting boss 26*a* and the second development supporting boss 26*b* are engaging portions (first engaging portions or driving-side engaging portions) that engage in the development supporting portion 73*f* and the driving-side frame hole 71*i*.

As shown in FIG. 4, in the nondriving-side development bearing 27 of the developing unit 20, a third development supporting boss 27*a* functioning as a third shaft portion (a second engaging portion or a nondriving-side engaging portion) is provided. The third development supporting boss 27*a* engages in the nondriving-side frame hole 71*j*.

Combination of the developing unit 20 and the drum unit 60 is performed according to a procedure explained below.

As shown in FIG. 7A, the drum supporting frame 71 includes a driving-side wall 71*a* and a nondriving-side wall 71*d* extending in a direction crossing the longitudinal direction. The driving-side frame hole 71*i* and the nondriving-side frame hole 71*j* are respectively provided in the driving-side wall 71*a* and the nondriving-side wall 71*d*. As shown in FIG. 7A, the developing unit 20 is slid in the longitudinal direction (an arrow G1 direction) with respect to the drum supporting frame 71. Consequently, as shown in FIG. 7B, on the driving side, the driving-side frame hole 71*i* and the second development supporting boss 26*b* engage. On the nondriving side, the nondriving-side frame hole 71*j* and the third development supporting boss 27*a* engage. Thereafter, as shown in FIG. 7C, when the drum supporting member 73 is attached to the drum supporting frame 71, the development supporting portion 73*f* and the first development supporting boss 26*a* engage. Consequently, the developing unit 20 is swingable combined (coupled) with the drum unit 60. In this embodiment, the development supporting portion 73*f* supports the first development supporting boss 26*a*. The nondriving-side frame hole 71*j* supports the third development supporting boss 27*a*. In this state, the developing unit 20 is swingable (turnable) around the first development supporting boss 26*a* and the third development supporting boss 27*a*. The second development supporting boss 26*b* is restricted from coming off the driving-side frame hole 71*i* and the third development supporting boss 27*a* is restricted from coming off the nondriving-side frame hole 71*j* by the development supporting portion 73*f*. The configuration shown in FIGS. 7A to 7C is a schematic configuration of the configuration shown in FIGS. 1, 6, and 10 and is functionally the same configuration.

At this time, as shown in FIG. 4, a first end portion 46Rb of a driving-side urging member 46R is fixed to the driving-side development bearing 26. A second end portion 46Ra of the driving-side urging member 46R is in contact with a surface 71*k*, which is a part of the photosensitive drum unit. As shown in FIG. 5, a first end portion 46Lb of the nondriving-side urging member 46L is fixed to the nondriving-side development bearing 27. A second end portion 46La is in contact with a surface 711, which is a part of the photosensitive drum unit.

In this embodiment, the driving-side urging member 46R (FIG. 4) and the nondriving-side urging member 46L (FIG. 5) are formed by compression springs. The development unit 20 is urged to the drum unit 60 by an urging force of these springs. Consequently, the developing roller 32 is surely pressed against the photosensitive drum 62. The developing roller 32 is held at a predetermined interval from the photosensitive drum 62 by the interval retaining members 38 attached to both the ends in the longitudinal direction of the developing roller 32.

In this embodiment, the disposition on the driving side of the cartridge B is as explained below. As shown in FIG. 8, the periphery of the hole portion 73*a*, which supports the drum end portion member 63, is fixed by a terpene-based solvent as a first fixed portion 73*b*. This intends to fix the vicinity of the hole portion 73*a*, which supports the drum end portion member 63, to achieve position accuracy of the photosensitive drum 62 in the drum unit 60 and stabilize image quality. That is, the drum supporting member 73 is bonded to the drum supporting frame 71 around the hole portion 73*a*. The second fixed portion 73*c* is disposed in the vicinity of the development supporting portion 73*f* This intends to fix the vicinity of the development supporting portion 73*f* for supporting the development unit 20 to achieve position accuracy of the development unit 20 with respect to the drum unit 60 and stabilize the image quality. The charging contact 69 and the cover portion 73*e* are disposed between the hole portion 73*a* and the development supporting portion 73*f*.

Recycling Method for the Cartridge

Figure 1:
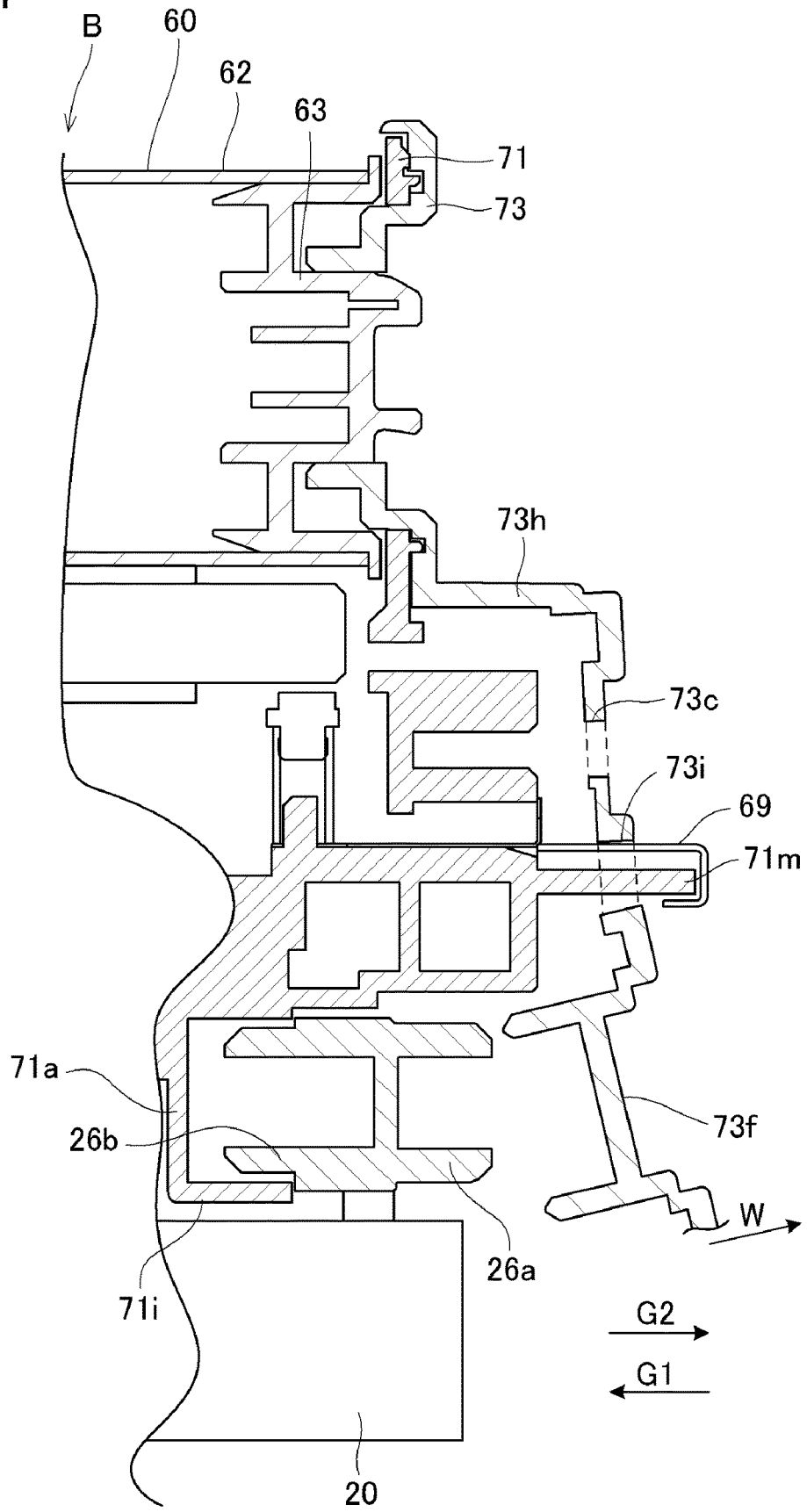
FIG. 1 is an explanatory diagram of a separating step and a combining step for a drum unit and a developing unit in an embodiment.
Figure 9A:
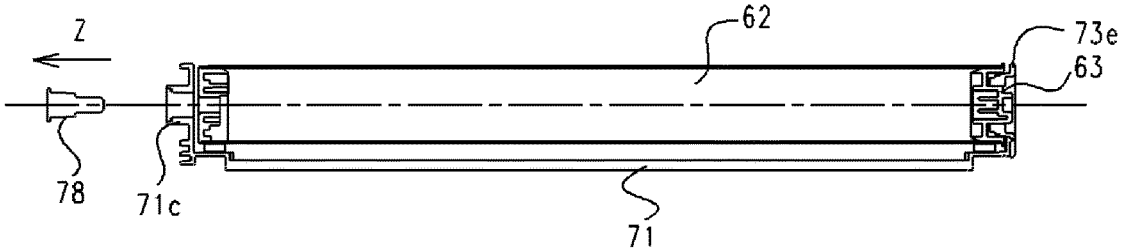
FIGS. 9A to 9C are explanatory diagrams showing a detachment configuration of a photosensitive drum in the embodiment.
Figure 9B:
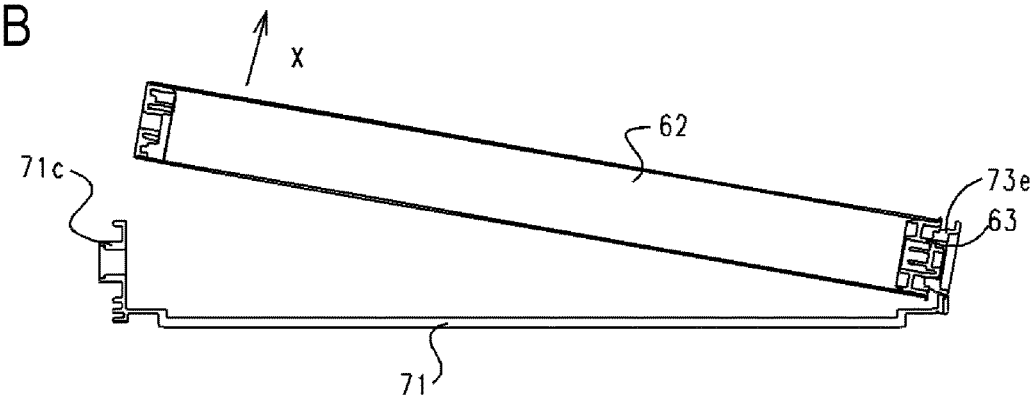
Figure 9C:
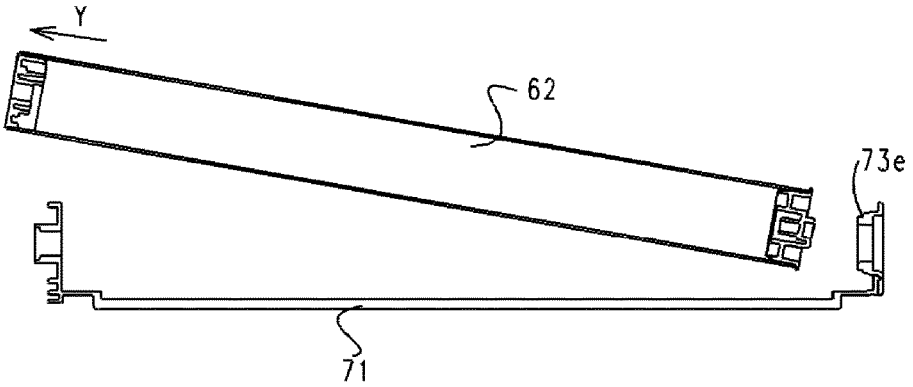
Figure 10:
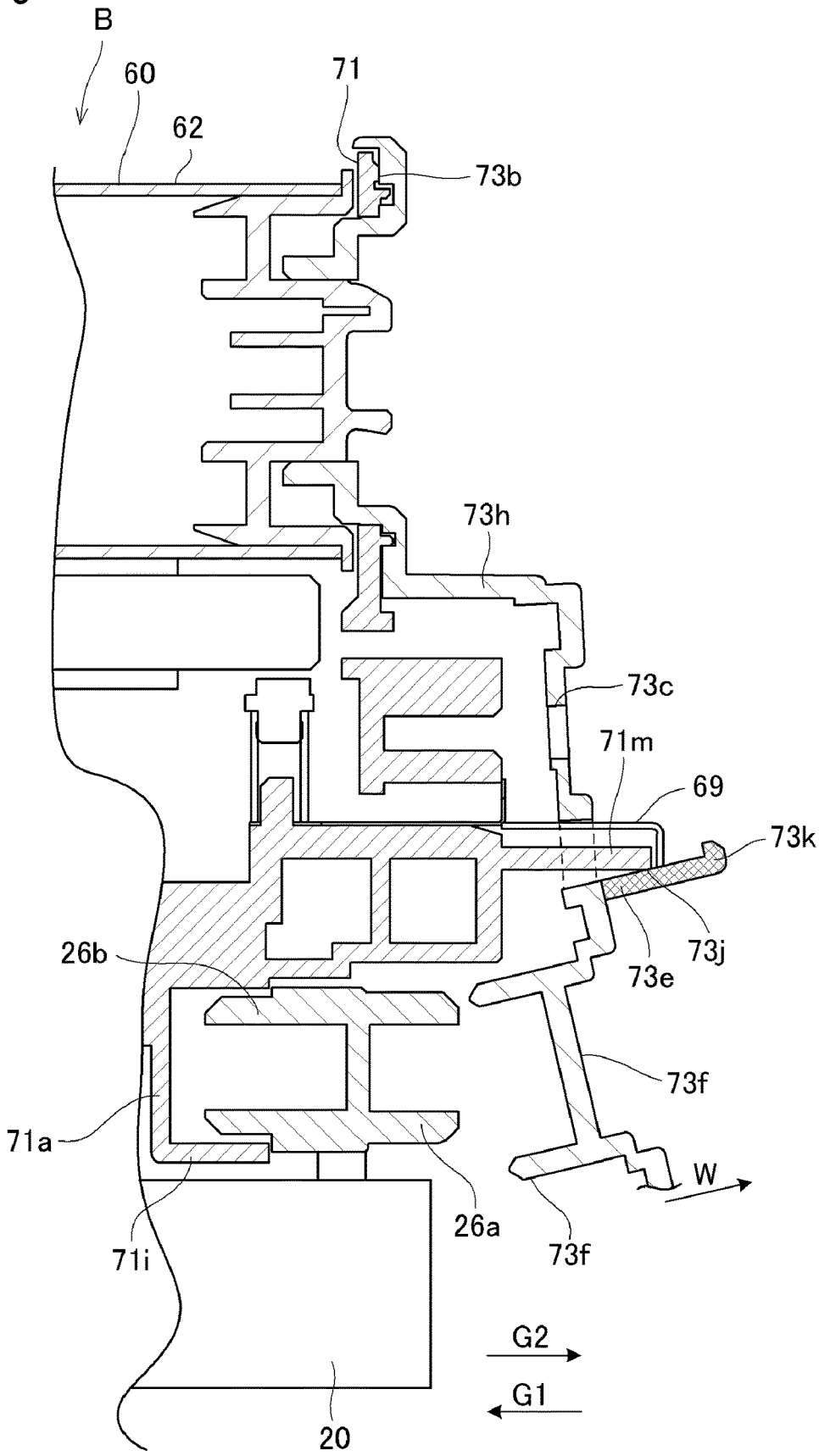
FIG. 10 is an explanatory diagram showing a separating step of the drum unit and the developing unit in the embodiment.

A recycling method for the cartridge B (a manufacturing method for manufacturing an image bearing unit) in this embodiment is explained with reference to FIGS. 1, 3, and 6 to 10. FIG. 1 is an explanatory diagram showing a separating step and a combining step for the drum unit 60 and the developing unit 20. FIG. 3 is a sectional view of the cartridge B. FIG. 6 is an explanatory diagram for explaining the configuration of the cartridge B. FIGS. 7A to 7C are explanatory diagrams showing a procedure of combination of the drum unit 60 and the developing unit 20. FIG. 8 is a longitudinal side view showing the configuration of the cartridge B. FIGS. 9A to 9C are explanatory diagrams showing a detachment configuration of the photosensitive drum 62. FIG. 10 is an explanatory diagram showing a separating step of the photosensitive drum unit 60 and the developing unit 20.

In the cartridge B attached to the apparatus main body A and used, the toner T stored in the toner chamber 29 is consumed according to repetition of image formation. When the toner is further consumed and an image of quality requested by a user cannot be formed, the cartridge B exhausts the life thereof. The used cartridge B that has exhausted the life can be reused by being collected and reproduced. In a step of the reproduction, disassembly, cleaning, component replacement, and the like of the cartridge B are performed. New toner is filled in the cartridge B. The reproduction of the used toner cartridge in this embodiment is completed through steps of (i) to (viii).

In this embodiment, the used cartridge B is defined as a "material unit". The material unit is a unit that can be disassembled and assembled and includes detachable components. The material unit is a unit used as a material in reproduction of a cartridge. The cartridge B functioning as the material unit does not have to be a used cartridge. The material unit includes, for example, the cartridge B collected because of some reason without exhausting the life thereof.

That is, the recycling method for the cartridge B according to this embodiment includes separating and taking out, from the material unit, the image bearing unit used as a part of a frame of the cartridge B in the reproduction of the cartridge B (manufacturing the image bearing unit) (a manufacturing step for the image bearing unit). In the following explanation in this embodiment, the image bearing unit including the drum supporting frame 71 and the drum supporting member 73 for supporting the photosensitive drum 62 is manufactured from the used cartridge B functioning as the material unit.

(i) A Removing Step for the Cover 73*e* of the Drum Supporting Member 73

In the reproduction of the cartridge B, it is desirable to separate the developing unit 20 and the drum unit 60 first. To separate the developing unit 20 and the drum unit 60, the drum supporting member 73 needs to be detached from the drum supporting frame 71. However, as explained above, in this embodiment, the drum supporting frame 71 and the drum supporting member 73 are combined by the terpene-based solvent in the first fixed portion 73*b* and combined by the screw 12 in the second fixed portion 73*c*.

The screw 12 of the second fixed portion 73*c* can be detached by a tool such as a screwdriver. On the other hand, a joined surface of the drum supporting frame 71 and the drum supporting member 73 in the first fixed portion 73*b* is melted by the terpene-based solvent. Therefore, when it is attempted to peel the joined surface by force, the drum supporting frame 71 and the drum supporting member 73 are likely to be broken or largely deformed. In particular, as shown in FIG. 6, the first fixed portion 73*b* includes the hole portion 73*a* that supports the photosensitive drum 62 (the adhesive portion is formed around the hole portion 73*a*). If the hole portion 73*a* is broken or deformed, the position accuracy of the photosensitive drum 62 in the cartridge B is deteriorated. If the position accuracy of the photosensitive drum 62 is deteriorated, the image quality is likely to be affected. Therefore, it is desirable that the developing unit 20 and the drum unit 60 can be separated without uncombining the first fixed portion 73*b*.

Therefore, as shown in FIG. 10, in a state in which the screw 12 of the second fixed portion 73*c* is removed, the drum supporting member 73 is deformed in the arrow W direction starting from the combining portion 73*h*. That is, the development supporting portion 73*f* is displaced with respect to the driving-side frame hole 71*i*. As shown in FIG. 8, the charging-contact disposing portion 71*m* and the cover portion 73*e* are located between the hole portion 73*a* surrounded by the adhesive portion and the development supporting portion 73*f* when viewed in the axis direction of the photosensitive drum 62. The development supporting portion 73*f* is displaced with respect to the fixed hole portion 73*a* side. Consequently, the development supporting portion 73*f* of the drum supporting member 73 and the first development supporting boss 26*a* of the developing unit 20 are disengaged. A space for sliding the developing unit 20 in an arrow G2 direction in order to separate the developing unit 20 and the drum unit 60 is formed. That is, the second development supporting boss 26*b* is allowed to be detached from the driving-side frame hole 71*i*. The third development supporting boss 27*a* is allowed to be detached from the nondriving-side frame hole 71*j*.

However, the drum supporting frame 71 and the drum supporting member 73 are bonded and fixed around the hole portion 73*a*. In this state, when the drum supporting member 73 is deformed in an arrow W direction to allow the development supporting portion 73*f* to be detached from the first development supporting boss 26*a*, the cover portion 73*e* comes into contact with the charging-contact disposing portion 71*m*. In the following explanation, a place where the cover portion 73*e* comes into contact with the charging-contact disposing portion 71*m* is referred to as "contact portion 73*j*". In this state, when the drum supporting member 73 is further deformed in the arrow W direction, in the contact portion 73*j*, the cover portion 73*e* interferes with the charging-contact disposing portion 71*m*. One or both of the charging-contact disposing portion 71*m* and the cover portion 73*e* are likely to be damaged.

Therefore, the periphery of the contact portion 73*j* of the cover portion 73*e* (a portion including at least the contact portion 73*j* of the cover portion 73*e*) is removed. In other words, at least a part of the contact portion 73*j* is removed. A portion removed at this time is a removed portion 73*k*. Consequently, the interference of the cover portion 73*e* and the charging-contact disposing portion 71*m* is reduced. It is desirable to remove, in the entire region in the longitudinal direction, a portion (a cross hatching region in FIG. 10) projecting further to the longitudinal direction outer side than the development supporting portion 73*f* in the cover portion 73*e*. Consequently, as shown in FIG. 1, even if the drum supporting member 73 is deformed in the arrow W direction, it is possible to more surely prevent the interference of the cover portion 73*e* and the charging-contact disposing portion 71*m*. As a result, it is possible to separate the developing unit 20 and the drum unit 60 without damaging the cartridge B.

On the other hand, in a direction crossing the longitudinal direction, when the cover portion 73*e* is removed, it is desirable to remove a part of the cover portion 73*e* rather than the entire cover portion 73*e*. That is, when viewed in the longitudinal direction, in the cover portion 73*e*, it is desirable that, when the drum supporting member 73 is deformed, a portion (a cross hatching portion in FIG. 8) interfering with the charging-contact disposing portion 71*m* is removed and the other portion is left. As explained above, the cover portion 73*e* has the two roles (preventing the user from touching the edge of the sheet metal of the charging contact 69 and protecting the charging-contact disposing portion 71*m* and the charging contact 69). Therefore, the removed cover portion 73*e* desirably returns to an original shape thereof after an end of a recycling step. In that case, a new member (a repairing member) is attached to the removed part by bonding or the like. A bonding area of the repairing member can be secured wider when a part of the cover portion 73*e* is removed than when the entire cover portion 73*e* is removed. That is, in the direction crossing the longitudinal direction, the repairing member can be bonded to the left portion of the cover portion 73*e*. Therefore, it is possible to increase strength after the bonding.

(ii) A Separating Step for the Developing Unit 20 and the Drum Unit 60 (a Deforming Step for Deforming the Drum Supporting Member 73 and a Unit Detaching Step (a Separating Step) for Detaching the Developing Unit 20 from the Development Supporting Portion 73*f*)

By removing a part of the cover portion 73*e*, even in a state in which the drum supporting frame 71 and the drum supporting member 73 are bonded and fixed around the hole portion 73*a*, it is possible to deform the drum supporting member 73 in the arrow W direction in FIG. 1. The development supporting portion 73*f* is allowed to be detached from the first development supporting boss 26*a*. In this state, when the developing unit 20 is slid in the arrow G2 direction, on the driving side, the driving-side frame hole 71*i* and the second development supporting boss 26*b* shown in FIG. 7B are disengaged. On the nondriving side, the nondriving-side frame hole 71*j* and the third development supporting boss 27*a* are disengaged. Then, the developing unit 20 and the drum unit 60 are separated.

Consequently, the developing unit 20 is separated from the cartridge B serving as a material and the drum unit 60 is manufactured. The manufactured drum unit 60 includes the photosensitive drum 62, the drum supporting frame 71, and the drum supporting member 73 in which at least a part of the cover portion 73*e* (at least a part of the contact portion 73*j*) is removed.

The step explained above can also be called a disassembling step (a disassembling method or a first disassembling step) for separating the developing unit 20 and the drum unit 60.

(iii) A Disassembling Step for the Drum Unit 60 (a Second Separating Step)

In disassembling the drum unit 60, first, the photosensitive drum is detached from the photosensitive drum unit. A procedure is as explained below.

As shown in FIG. 9A, the drum shaft 78 is pulled out in an arrow Z direction from the nondriving side of the drum unit 60. Thereafter, the photosensitive drum 62 is detached from the drum supporting frame 71. In this embodiment, the drum supporting member 73 and the drum supporting frame 71 are combined by the first fixed portion 73*b* and the first surface 73*d*. In this state, the photosensitive drum 62 remains being supported by the hole portion 73*a* of the drum supporting member 73. Therefore, the photosensitive drum 62 is detached by the following method.

As shown in FIG. 9B, the nondriving side of the photosensitive drum 62 is lifted in an arrow X direction. Subsequently, as shown in FIG. 9C, the photosensitive drum 62 is detached from the drum supporting frame 71 while being moved in an oblique direction (an arrow Y direction in FIG. 9C) with respect to the drum supporting frame 71.

After the detachment of the photosensitive drum 62, the charging roller 66 and the cleaning blade 77 are detached from the drum supporting frame 71. At this time, cleaning of the drum supporting frame 71, the charging roller 66, and the cleaning blade 77 is performed according to necessity. A method of the cleaning is, for example, air suction, blow, wet cleaning, or wiping. Removed toner removed from the photosensitive drum 62 by the cleaning blade 77 is collected.

(iv) A Disassembling Step for the Developing Unit 20

In the separated developing unit 20, the driving-side development bearing 26 and the nondriving-side development bearing 27 are detached from the developer container 23. Further, the developing roller 32 and the developing blade 42 are detached from the developer container 23. Cleaning of the developer container 23, the developing roller 32, and the developing blade 42 is performed according to necessity.

(v) A Toner Filling Step for the Developing Unit 20

After the disassembling step for the developing unit 20, new toner T is refilled in the toner chamber 29 of the developer container 23. The refilling of the toner is performed from, for example, a toner supply opening 23*d* (see FIG. 3) of the developer container 23 in a state in which the developing roller 32 and the developing blade 42 are detached. At this time, the developer container 23 is held to direct the toner supply opening 23*d* upward. A funnel (not shown in FIG. 3), the size of the distal end of which is substantially the same as or smaller than the toner supply opening 23*d*, is put on the toner supply opening 23*d*. A predetermined amount of the toner T is filled in the toner chamber 29 from the funnel via the toner supply opening 23*d*.

(vi) An Assembling Step for the Developing Unit 20

When the toner filling step is completed, the toner supply opening 23*d* is sealed by a sealing member (not shown in FIG. 3). The developing roller 32, the developing blade 42, the driving-side development bearing 26, the nondriving-side development bearing 27 are assembled to the developer container 23 in a procedure opposite to the disassembling of the developing unit 20 explained in (iv). Consequently, the reassembling of the developing unit 20 (the manufacturing of the new developing unit 20 different from the developing unit 20 before the disassembly) is completed. The new developing unit 20 may be manufactured anew. The detached developing unit 20 may be used as it is without being disassembled depending on a state of the detached developing unit 20.

(vii) An Assembling Step for the Drum Unit 60

Subsequently, the cleaning blade 77, the charging roller 66, and the photosensitive drum 62 are assembled to the drum supporting frame 71 in a procedure opposite to the disassembling of the drum unit 60 explained in (iii) (a second attaching step). Consequently, the reassembly of the drum unit 60 is completed. A new photosensitive drum different from the detached photosensitive drum 62 may be attached. In that case, the photosensitive drum 62 manufactured anew may be attached. Replacement of the photosensitive drum 62 may be omitted depending on a state of the photosensitive drum 62.

(viii) A Combining Step for the Developing Unit 20 and the Drum Unit 60

Finally, the developing unit 20 and the drum unit 60 are recombined in a procedure opposite to the separation of the developing unit 20 and the drum unit 60 explained in (ii). In that case, as shown in FIG. 1, the drum supporting member 73 is deformed in the arrow W direction (a second deforming step) and, in that state, the developing unit 20 is slid in the arrow G1 direction and attached to the drum supporting frame 71 (an attaching step). Consequently, the driving-side frame hole 71*i* and the second development supporting boss 26*b* engage. The nondriving-side frame hole 71*j* and the third development supporting boss 27*a* engage. By releasing the deformation of the drum supporting member 73, the driving-side development bearing 26 of the developing unit 20 is held between the driving-side wall 71*a* and the drum supporting member 73 and the developing unit 20 and the drum unit 60 are coupled (a deformation releasing step). Consequently, the first development supporting boss 26*a* and the development supporting portion 73*f* engage. The developing unit 20 is swingably coupled to the drum supporting frame 71. Thereafter, the drum supporting frame 71 and the second fixed portions 71*e* and 73*c* of the drum supporting member 73 are combined by the screw 12. Consequently, recombination of the developing unit 20 and the drum unit 60 is completed. Further, concerning the cover portion 73*e*, a repairing member corresponding to the part removed in the step of (i) is attached by bonding or the like (a bonding step). The repairing member desirably has substantially the same shape as the removed portion. For example, the repairing member has the same shape as the removed portion 73*k* indicated by hatching portions in FIGS. 8 and 10. Consequently, the cover portion 73*e* returns to a shape before the reproduction.

The reproduction of the cartridge B (manufacturing of a new cartridge B from the used cartridge B) is completed by performing the steps of (i) to (viii) as explained above. In this embodiment, since a step for detaching the drum supporting member 73 is not performed, it is possible to easily perform the reproduction of the cartridge B. In this embodiment, even if the developing unit 20 is separated, a positional relation between the hole portion 73*a* and the drum supporting frame 71 can be maintained. In particular, in this embodiment, since the drum supporting member 73 is bonded to the drum supporting frame 71 around the hole portion 73*a*, it is easy to maintain the positional relation between the hole portion 73*a* and the drum supporting frame 71. Therefore, even if the developing unit 20 is separated in the configuration in which the drum supporting member 73 includes the hole portion 73*a* and the development supporting portion 73*f*, it is unnecessary to provide a step for adjusting the position of the photosensitive drum 62 or a new photosensitive drum. That is, even if a special step is not provided, a positional relation between the photosensitive drum 62 or the new photosensitive drum and the drum supporting frame 71 can be set to a positional relation equivalent to the positional relation in the cartridge B functioning as the material unit. Therefore, it is possible to easily perform the reproduction of the cartridge B. The order of the steps can be changed as appropriate.

Use forms of this embodiment include the following cases. A used process cartridge is collected and disassembled. Components taken out from the cartridge by the disassembling are inspected. As a result of the inspection, the same reusable components are collected. The cartridge is reproduced by the recycling method explained above using the reusable components.

Further, the use forms of this embodiment include the following cases. A used process cartridge is collected and disassembled. Components taken out from the cartridge by the disassembling are inspected. As a result of the inspection, non-reusable components are replaced with new components or reusable components taken out from another cartridge. The cartridge is reproduced by the recycling method explained above.

When components are reused, a cartridge from which the components are detached and a cartridge to which the detached components are attached do not need to be the same.

According to the present invention, it is possible to provide a simple manufacturing method for manufacturing an image bearing unit that supports an image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-068209, filed Mar. 30, 2018, which is hereby incorporated by reference herein in its entirety.

What is claimed is:

1. A manufacturing method for manufacturing an image bearing unit from a material unit, the material unit including:

an image bearing member;

a frame including a first engaged portion, the frame including a projecting portion projecting toward an outer side of the frame with respect to an axis direction of the image bearing member;

a supporting member including a fixed portion fixed to the frame, the supporting member including a bearing portion that supports the image bearing member, a through-hole, a second engaged portion opposed to the first engaged portion, and a cover portion that covers at least a part of the projecting portion penetrating the through-hole, the cover portion including a contact portion; and a developing unit including an engaging portion, the engaging portion engaging with the first engaged portion and the second engaged portion such that the developing unit being swingably coupled to the frame, wherein the contact portion is configured to come into contact with the projecting portion when the supporting member is deformed to allow the second engaged portion to be detached from the engaging portion in a state in which the fixed portion is fixed to the frame, the manufacturing method comprising:

a removing step of removing at least a part of the contact portion from the supporting member;

a deforming step of deforming the supporting member to allow the second engaged portion to be detached from the engaging portion in the state in which the fixed portion is fixed to the frame; and a separating step of detaching the engaging portion from the first engaged portion and separating the developing unit from the frame.

2. The manufacturing method according to claim 1, wherein, when viewed in the axis direction, the projecting portion and the cover portion are located between the bearing portion and the second engaged portion.

3. The manufacturing method according to claim 1, wherein the fixed portion is a portion bonded to the frame around the bearing portion, and in the deforming step, the supporting member is deformed in a state in which the fixed portion is bonded to the frame.

4. The manufacturing method according to claim 3, wherein the frame and the supporting member are formed of a styrene-based resin composition and bonded by a terpene-based solvent.

5. The manufacturing method according to claim 1, wherein the material unit includes an electrode disposed to cover the projecting portion, and the cover portion covers the projecting portion to expose at least a part of the electrode.

6. The manufacturing method according to claim 1, wherein the bearing portion is located on an inner side of the cover portion with respect to the axis direction.

7. The manufacturing method according to claim 6, wherein, in the deforming step, a combining portion connecting the bearing portion and the second engaged portion is deformed.

8. The manufacturing method according to claim 1, further comprising:

a second separating step of detaching the image bearing member from the bearing portion and separating the image bearing member from the frame; and an attaching step of attaching the image bearing member or an image bearing member different from the image bearing member to the bearing portion.

9. A manufacturing method for manufacturing a cartridge detachably attachable to an apparatus main body of an image forming apparatus, the manufacturing method comprising:

a manufacturing step of manufacturing the image bearing unit according to the manufacturing method for manufacturing the image bearing unit according to claim 8; and a developing-unit attaching step of attaching the developing unit or a developing unit different from the developing unit to the first engaged portion.

10. The manufacturing method according to claim 9, further comprising a repairing step of attaching, to a portion where at least a part of the cover portion is removed, a repairing member that covers at least a part of the projecting portion.

11. The manufacturing method according to claim 9, further comprising a second deforming step of deforming the supporting member, wherein the developing-unit attaching step is performed in a state in which the supporting member is deformed in the second deforming step.

12. The manufacturing method according to claim 11, further comprising a deformation releasing step of releasing the deformation of the supporting member after the developing-unit attaching step is performed.

13. A manufacturing method for manufacturing a cartridge detachably attachable to an apparatus main body of an image forming apparatus, the manufacturing method comprising:

a manufacturing step of manufacturing the image bearing unit according to the manufacturing method for manufacturing the image bearing unit according to claim 1; and a developing-unit attaching step of attaching the developing unit or a developing unit different from the developing unit to the first engaged portion.

14. The manufacturing method according to claim 13, further comprising a repairing step of attaching, to a portion where at least a part of the cover portion is removed, a repairing member that covers at least a part of the projecting portion.

15. The manufacturing method according to claim 13, further comprising a second deforming step of deforming the supporting member, wherein the developing-unit attaching step is performed in a state in which the supporting member is deformed in the second deforming step.

16. The manufacturing method according to claim 15, further comprising a deformation releasing step of releasing the deformation of the supporting member after the developing-unit attaching step is performed.

* * * * *